US009357283B2

(12) United States Patent
Darlington

(10) Patent No.: US 9,357,283 B2
(45) Date of Patent: May 31, 2016

(54) EARPHONE APPARATUS

(75) Inventor: Paul Darlington, Bussigny-pres-Lausanne (CH)

(73) Assignee: Soundchip SA, Bussigny-pres-Lausanne (CH)

( * ) Notice: Subject to any disclaimer, the term of this patent is extended or adjusted under 35 U.S.C. 154(b) by 200 days.

(21) Appl. No.: 14/003,321

(22) PCT Filed: Mar. 6, 2012

(86) PCT No.: PCT/GB2012/050498
§ 371 (c)(1),
(2), (4) Date: Sep. 5, 2013

(87) PCT Pub. No.: WO2012/120295
PCT Pub. Date: Sep. 13, 2012

(65) Prior Publication Data

US 2013/0343564 A1 Dec. 26, 2013

(30) Foreign Application Priority Data

Mar. 7, 2011 (GB) ..... 1103824.7
Nov. 25, 2011 (GB) ..... 1120370.0

(51) Int. Cl.
*H04R 1/02* (2006.01)
*H04R 1/10* (2006.01)

(52) U.S. Cl.
CPC ..... *H04R 1/1016* (2013.01); *H04R 1/1083* (2013.01)

(58) Field of Classification Search
USPC ..... 381/338
See application file for complete search history.

(56) References Cited

U.S. PATENT DOCUMENTS

| | | | | |
|---|---|---|---|---|
| 6,995,715 | B2 | 2/2006 | Ying et al. | |
| 7,537,964 | B2 | 5/2009 | Minervini | |
| 7,548,628 | B2 | 6/2009 | Hawker et al. | |
| 7,728,779 | B2 | 6/2010 | Korner | |
| 2003/0132056 | A1 * | 7/2003 | Meyer et al. | 181/187 |
| 2004/0184632 | A1 * | 9/2004 | Minervini | 381/355 |
| 2005/0105749 | A1 | 5/2005 | Niederdrank et al. | |
| 2006/0097930 | A1 | 5/2006 | Rosenberg et al. | |
| 2007/0026905 | A1 | 2/2007 | Murray | |

(Continued)

FOREIGN PATENT DOCUMENTS

| | | | |
|---|---|---|---|
| WO | 9120161 | | 12/1991 |
| WO | 02056293 | A1 | 7/2002 |
| WO | 2006118680 | | 11/2006 |

OTHER PUBLICATIONS

International Search Report in International Patent Application No. PCT/GB2012/050498, dated Jun. 4, 2012, 4 pages.

(Continued)

*Primary Examiner* — Davetta W Goins
*Assistant Examiner* — James Mooney
(74) *Attorney, Agent, or Firm* — Lempia Summerfield Katz LLC

(57) ABSTRACT

Earphone apparatus (40) comprising: a substantially planar substrate (43) defining at least one electrical connection path (44); an electro-acoustic driver (41) and sensing microphone (42) each mounted on the substrate (43) and connected to the at least one electrical connection path (44); wherein the substrate (43) at least in part defines an acoustic waveguide (47) having a part extending through the substrate (43) for conveying sound from outside of the earphone apparatus (40) to the sensing microphone (42); and the part of the acoustic waveguide (47) extends through the substrate (43) substantially normal to the thickness of the substrate (43).

18 Claims, 9 Drawing Sheets

(56) References Cited

U.S. PATENT DOCUMENTS

| | | | | |
|---|---|---|---|---|
| 2008/0298624 | A1 | 12/2008 | Jeong et al. | |
| 2009/0208047 | A1* | 8/2009 | Ngia et al. | 381/338 |
| 2012/0177229 | A1* | 7/2012 | Lorenz et al. | 381/111 |

OTHER PUBLICATIONS

UK Combined Search and Examination Report for GB1103824.7, dated Jun. 15, 2011, 5 pages.

Written Opinion in International Patent Application No. PCT/GB2012/050498, dated Jun. 4, 2012, 5 pages.

* cited by examiner

EARPHONE APPARATUS

RELATED APPLICATION DATA

This U.S. national phase application is based on international application no. PCT/GB2012/050498, filed on Mar. 6, 2012, which claimed priority to British national patent application numbers 1103824.7, filed on Mar. 7, 2011, and 1120370.0, filed on Nov. 25, 2011. Priority benefit of these earlier filed applications is hereby claimed.

DESCRIPTION

The present invention relates to audio apparatus and particularly, but not exclusively, to audio apparatus for use in portable devices (e.g. earphones (including noise reducing earphones), portable communications devices and portable media devices).

Earphones (e.g. circumaural or supra-aural earphones of the type connected together by a headband to form headphones or in-ear devices (often referred to as earbuds)/"in-the-canal" devices configured to be placed at the entrance to or in the auditory canal of a user's ear and alternatively referred to as in-ear headphones/monitors) are electro-acoustic systems for the delivery of sound to a user. Earphones incorporate at least one electro-acoustic transducer (i.e. driver) acting as a miniature loudspeaker. With reference to the legacy of the nomenclature developed in telephone engineering, the miniature loudspeakers provided in earphones are referred to as "receivers". The receiver must be mounted in a convenient earphone assembly for storage and insertion in or at the entrance to the wearer's ear canal. The earphone assembly must be designed so as to conduct sound generated by the receiver to the user's ear in an engineered fashion, such that the assembly serves an acoustical function. Finally, the earphone assembly must incorporate means to make electrical connection to the receiver in order to conduct the audio signals to be transduced. It is seen that the earphone assembly provides mechanical, acoustical and electrical support for the receiver.

In subsequent developments, active electronic means have been incorporated into earphone systems, furnishing them with the capability to cancel (at least some useful portion of) unwanted external sound and/or to cancel excess pressures generated in the blocked (or "occluded") ear canal during speech. This latter phenomenon, called "the occlusion effect", makes it uncomfortable to speak whilst wearing certain earphone types. Active reduction of the occlusion effect is seen as a desirable feature of earphones used in telephony and other voice applications.

To provide active control of noise or occlusion, and to add other advanced functionality, it is necessary to add additional sensors to the earphone. Specifically, microphones configured to be sensitive to either or both of the pressures inside the occluded ear canal or outside the head are required. Integration of these microphones requires that they are incorporated into the earphone assembly with due consideration for mechanical mounting, acoustical configuration and electronic connection.

The provision of support in mechanical, acoustical and electrical domains to all of the transducers in an earphone complicates design and manufacture of the device, often leading to a plurality of individual components, sub-assemblies and manufacturing processes.

FIG. 1 shows a prior art earphone 10 typical of a custom-moulded "in-ear monitor", with two receivers 11 sound from which is conducted to the ear through plastic pipes 12. Electronic connectivity is achieved via the printed-circuit board 13 which may further carry electronic components (e.g. as "crossover" to derive signals for each of the two receivers) 14. The entire assembly is mounted within a moulded body 15 which may advantageously be custom-moulded to fit the wearer's ear. The cable 16 conveying electrical signals to the earphone 6 may include a knot 17 or equivalent means to achieve mechanical strain relief The Balanced Armature receivers 11 tube acoustic coupling 12 and moulded body form 15 of earphone 10 are legacies of the hearing aid industry. Many similar legacies are informing contemporary earphone design and construction.

FIG. 2 shows a further example of a prior art earphone 20, this example incorporating active noise reduction technology. Sound from the dynamic or "moving coil" receiver 21 is sensed by microphone 22 in the course of its passage to the ear. The sound from receiver 21 is conducted toward the ear through a pipe (or "waveguide") formed in collar 23, the end of which is terminated with a rubber "grommet" or "tip" 24 which ensures an air-tight and comfortable fit to the wearer's ear. The receiver and microphone are located within a deep-drawn metal casing 25. The receiver rests against a registering "shoulder" generated by a change in cross-sectional area of 25 and the microphone is secured by a plastic microphone holder 26.

A printed circuit board 27 holds electronic components 28 and provides electrical connection between the devices within the earphone and the cable 29. The end of the capsule 25 is swaged over a ring component 30 to retain the contents of the capsule. An outer shell 31 is applied over the casing. This shell contributes to the comfort and acoustic fit of the earphone and provides opportunity to express industrial design, apply branding and similar cosmetic considerations. The shell component 31 also contains a "grille" or venting arrangement 32 which defines the acoustic backload of the receiver.

The various prior art implementations of earphone systems described demonstrate the large number and variety of components within typical earphone systems. Across this plurality of components, individual components are seen to serve individual (or, at best, double) purpose; either mechanical, electrical or acoustical.

The present applicant has identified the need for a new audio apparatus construction to address or at least alleviate problems associated with the prior art.

In accordance with a first aspect of the present invention, there is provided audio apparatus comprising: a substrate defining at least one electrical connection path; and a transducer provided on or in (e.g. mounted on or in) the substrate and connected to the at least one electrical connection path; wherein: the transducer comprises an electro-acoustic driver and the substrate at least in part defines an acoustic waveguide (i.e. an air-filled passageway configured to support pressure difference along its length in the propagation of an acoustic wave) having a part (e.g. passageway part) extending through the substrate for conveying sound from the electro-acoustic driver to an opening in the audio apparatus for conveying sound to a user; or the transducer comprises a microphone and the substrate at least in part defines an acoustic waveguide having a part (e.g. passageway part) extending through the substrate for conveying sound (e.g. external sound to be monitored) from outside of the audio apparatus to the microphone.

In this way audio apparatus is provided in which the mechanical, acoustical and electrical support roles for the transducer(s) may be implemented by a single substrate component (e.g. substrate configured to carry the or each transducer), leaving the remainder of the assembly to provide a substantially cosmetic role. By combining the mechanical, acoustical and electrical support roles for the transducer into a single component efficiency of manufacture may be significantly improved by virtue of a shared manufacturing process as well as potentially assisting miniaturisation. The scope of the invention includes all present and future electro-acoustic systems for the presentation of audio signals for entertainment, communication, assisted listening and other augmentations of audition (which all shall be signified by the name "audio apparatus").

The term acoustic waveguide is used in its conventional sense in the art to indicate an air-filled passageway (e.g. of substantially constant or gradually changing impedance along its length, e.g. substantially constant or gradually changing cross-sectional area along its length) configured to support the propagation of acoustic waves in air contained in the passageway. Common examples of acoustic waveguides include pipes for the propagation of plane acoustic waves and horns for the deliberate introduction of a gradual impedance change by the manipulation of wave-fronts of an acoustic wave. In the case of an elongate acoustic waveguide, the acoustic waveguide may support a plurality of phases of the acoustic wave (or components thereof) as the acoustic wave is propagated along the acoustic waveguide and require that the behaviour of the waveguide is analysed and described mathematically with reference to partial differential equations. This distinguishes such a waveguide from a bounded spaced in which the air moves (to a first order of approximation) as a substantially "lumped parameter", wherein the system is controlled by an ordinary differential equation. Such "lumped parameter" spaced include sealed volumes and constrictions intended to express inductive or resistive impedance, such as the sealed volumes often used to deal with rearward radiation from an electro-acoustic driver.

The at least one electrical connection may be configured to provide at least one of: a power, signal, reference or control connection to/from the transducer.

In a first group of embodiments the substrate is a substantially planar (or plate-like) substrate (e.g. with a thickness less than $1/5^{th}$ or even less than $1/10^{th}$ of its smallest mean dimension in any direction orthogonal to its thickness) and the part of the acoustic waveguide extends substantially normal to the thickness of the substrate (e.g. to guide sound along propagation vectors substantially parallel to a plane of the substantially planar substrate).

In one embodiment the substantially planar substrate is a substantially planar circuit substrate (e.g. a substantially planar substrate defining at least one integral electrical connection as discussed in more detail below).

The substantially planar circuit substrate may be a multilayer substrate (e.g. formed from a plurality of at least partially overlapping layers). In one embodiment, the multilayer substrate is formed by bonding multiple layers during a lamination process. In another embodiment, the multilayer substrate is formed by sequentially forming a plurality of layers during a semiconductor device fabrication process.

In one embodiment the at least one electrical connection path is an integral surface-formed connection path (e.g. formed in a surface etching process). For example, in one embodiment the substantially planar circuit substrate may be a printed circuit board (PCB) assembly.

In another embodiment the at least one electrical connection path is an integral embedded connection path (e.g. formed by sequentially forming a plurality of layers during a semiconductor device fabrication process). For example, in one embodiment the substantially planar circuit substrate may be a substrate comprising an electrical connection path embedded in a layered structure formed on a semiconductor wafer (e.g. formed by sequentially depositing the plurality of layers during a semiconductor device fabrication process). In one embodiment the substrate may be semiconductor device such as a microchip (e.g. a chip comprising an electrical connection path embedded in a layered structure formed on a semiconductor wafer, for example an integrated circuit) or a MEMS device.

In a second group of embodiments the substrate is a non-planar circuit substrate (e.g. a non-planar substrate defining at least one integral electrical connection path).

In one embodiment the non-planar circuit substrate is a multilayer circuit substrate (e.g. formed by a plurality of at least partially overlapping layers). In one embodiment, the multilayer substrate is formed by bonding multiple layers during a lamination process. In another embodiment, the multilayer substrate is formed by sequentially forming a plurality of layers during a semiconductor device fabrication process).

In one embodiment the part of the acoustic waveguide extends through an inner layer of the multilayer circuit substrate. In one embodiment the part of the acoustic waveguide extends substantially normal to the thickness of the inner layer.

In one embodiment the part of the acoustic waveguide extends through the inner layer and at least one further layer. In one embodiment the part of the acoustic waveguide extends substantially parallel to the thickness of the inner and at least one further layer.

In one embodiment, the part of the acoustic waveguide has a first section extending substantially parallel to the thickness of the inner and at least one further layer and a second section extending substantially normal to the thickness of the inner and at least one further layer. In this way, the part of the waveguide may alter the direction of the sound wave passing therethrough (e.g. to guide the wave to or from the transducer).

In one embodiment the at least one electrical connection path is an integral surface-formed connection path (e.g. formed in a surface etching process or surface or micromachining process). For example, the non-planar circuit substrate may comprise a non-planar printed circuit board (PCB).

In another embodiment the at least one electrical connection path is an integral embedded connection path (e.g. formed during a multilayer semiconductor device fabrication process). For example, the non-planar circuit substrate may be a non-planar semiconductor device (e.g. non-planar microchip or non-planar MEMS device).

In each of the first and second groups of embodiments defined above the following further optional features may apply:

In one embodiment the acoustic waveguide may be elongate (e.g. has a length greater than its largest mean width in any direction orthogonal to its length).

In one embodiment the substrate comprises a part extending laterally beyond an outer periphery of the transducer (e.g. in a direction normal to the thickness of the substrate). In one embodiment, the part of the acoustic waveguide extends through the part of the substrate (e.g. whereby the part of the acoustic waveguide directs sound between the transducer and a point outside of the lateral outer periphery of the transducer). In this way, greater phase differences may exist between pressures across the substrate than on the transducer alone.

In one embodiment the part of the acoustic waveguide is formed by a channel in an outer surface of the substrate. In another embodiment, the part of the acoustic waveguide may be formed by a passageway having a section formed fully within the substrate. In both embodiments the part of the acoustic waveguide may be formed by an etching, milling or micro-machining process (e.g. using a laser cutting technique). In the case of a multilayer substrate (e.g. multilayer circuit substrate) the acoustic waveguide may be constructed by forming a channel in one or more inner layers of the multilayer substrate (e.g. by etching, milling or micro-machining process) and covering the channel with an upper layer (e.g. pre-formed upper layer) to form a section formed fully within the substrate.

In the case of an acoustic waveguide part formed by a channel, the channel may be located on a surface of the substrate to which the transducer is attached (e.g. upper or lower surface of a substantially planer substrate). An upper surface of the acoustic waveguide part may be formed by a layer applied to the substrate to cover the channel. The channel and at least one electrically conductive track may extend along a common surface of the substrate.

In one embodiment, the part of the acoustic waveguide extends substantially from the transducer to the opening in the audio apparatus.

In another embodiment, the part of the acoustic waveguide is connected to the transducer by a connection chamber. In this way, lumped parameter behaviour may be encouraged at a location in the substrate for providing compliance.

In one embodiment the audio apparatus comprises a further acoustic waveguide having a part extending through the substrate and connected (e.g. in series) with the first-defined acoustic waveguide, the further acoustic waveguide having a reduced cross-sectional area relative to the first-defined acoustic waveguide (e.g. having a tendency to exhibit principally resistive or inductive behaviour). In this way, lumped parameter behaviour may be encouraged at a location in the substrate to cause the connected acoustic waveguides to behave (either alone or in combination with a chamber) as a resonator (e.g. second-order resonator) or an acoustic filter (e.g. low-pass, high pass or band-pass acoustic filter), as well as to implement addition and subtraction of signals in a controlled or deterministic manner.

In one embodiment the part of the acoustic waveguide comprises a manifold structure (e.g. for conveying sound between the transducer and a plurality of outlets). In this way, the acoustic waveguide may be configured to split or combine acoustic waves.

In the case of audio apparatus comprising a microphone, the acoustic waveguide may be configured to combine sound from a plurality of outlets into one path for the microphone. In this way, a direction response may be provided to the "composite microphone" formed by the microphone, the substrate and any further structure of the audio apparatus.

In the case of audio apparatus comprising an electro-acoustic driver, the acoustic waveguide may be configured to split sound received from the electro-acoustic driver into a plurality of waves travelling in parallel via different waveguide branches. The manifold structure may be configured to modify the radiation load presented to a source driving the electro-acoustic driver and/or to alter sound radiation from the substrate in analogy with a conventional acoustic horn. In another embodiment, the plurality of outlets are positioned in the audio apparatus to generate a directional sound field.

In one embodiment the acoustic waveguide (e.g. the part of the acoustic waveguide extending through the substrate or another part) has a profile which is modifiable. For example, the acoustic waveguide may be modifiable by elastic deformation of the substrate or by the action of a mechanical actuator. In one embodiment the mechanical actuator is an acousto-mechnical component (e.g. a valve configured to temporarily seal an otherwise open acoustic path in which the presence of a high pressure pulse). In another embodiment, the mechanical actuator comprises a mechanical gating device configured to modify the acoustic behaviour of the acoustic waveguide.

In one embodiment, the substrate defines at least one electrically conductive track leading to a connection point (e.g. solder pad). The at least one electrically conductive track and/or connection point may extend along an outer surface of the substrate (e.g. upper or lower surface in the case of a substantially planar substrate).

In one embodiment, the substrate is configured to provide secondary electrical functions (e.g. providing a common ground for the audio apparatus or provide means for reducing radio frequency interference).

In the case of audio apparatus comprising an electro-acoustic driver, the driver may be any suitable type of driver. In one embodiment, the driver is a Balanced Armature (BA) driver or other high source impedance driver (e.g. a driver having an acoustic source impedance that is higher than the acoustic input impedance of the human ear over substantially the entire human hearing range of frequencies (e.g. over the range 20 Hz-20 kHz)).

In one embodiment, the transducer forms an integral part of the substrate (e.g. where the substrate is a semiconductor device the transducer may be integral to the semiconductor device). For example, the substrate may include a substrate of the transducer (e.g. silicon wafer of a MEMS microphone).

In one embodiment, at least one further transducer is provided in or on (e.g. mounted on) the substrate (e.g. one or more further electro-acoustic transducers (e.g. driver or microphone) or one or more transducers for non-acoustic variables such as position or its time derivatives). In the case of a further electro-acoustic transducer, sound may be conveyed to or from the further transducer via the acoustic waveguide or a via further acoustic waveguide. The or the further acoustic waveguide may include a part extending through the substrate substantially from the further transducer to the opening or to a further opening in the audio apparatus. The substrate may further define at least one (e.g. integral) electrical connection for the further transducer.

In the case of audio apparatus including a further acoustic waveguide, the further acoustic waveguide may have a further opening spaced from the first-defined opening. The relative positioning of the first-defined and further opening may be configured to provide directionality (e.g. a directional input or output depending upon whether the transducer is a microphone or electro-acoustic driver respectively).

The further acoustic waveguide may be formed at least in part by the substrate or may alternatively be provided by an acoustic waveguide distinct from the substrate.

In the case of a first-defined acoustic waveguide comprising a manifold structure, the further acoustic waveguide may also comprise a manifold structure leading to a plurality of openings (e.g. for conveying sound between the further transducer and a plurality of further outlets). In the case of audio apparatus comprising an electro-acoustic driver, the each manifold structure may be configured to modify the radiated sound from the first-defined and further electro-acoustic drivers, e.g. for the purpose of generating a directional sound field. In the case of audio apparatus comprising a microphone, independent pressures existing at the plurality of openings may be combined in a controlled manner (e.g. to provide a more flexible directional microphone than is convenient with acoustic summation alone).

In one embodiment, the or the at least one further transducer is mounted on the substrate via an intermediate part (e.g. vibration-absorbing part).

The substrate provides mechanical support to the or at least one transducer of the audio apparatus when it serves the purpose of locating or securing said transducer (in any one of three spatial dimensions) at any point during the manufacturing/assembly process or throughout the subsequent life and use of the audio apparatus.

The substrate provides acoustic functional support to the or at least one transducer of the audio apparatus when any sound from or to said transducer is conducted through air part-bounded by the substrate. This sound includes both direct sound and sound associated with other modifications of radiation load, vents, pressure equalisation releases, acoustic filters and the like. It includes only front-radiation from electro-acoustic actuators which are partially open backed, such as dynamic receivers (front-radiation being that sound which arises from the "front" of the diaphragm: that side of the diaphragm acoustically coupled to the wearer's ear). The waveguide boundaries in or on the substrate may be formed by any process of machining, etching or deposition, etc extant or not yet invented.

The substrate provides electrical functional support to the or at least one transducer of the audio apparatus when electrical signal (or power) is transmitted through conducting paths in or on the substrate. The conducting path(s) may be formed on or in the substrate by any process of etching, deposition, etc extant or not yet invented. In accordance with a second aspect of the present invention, there is provided a module for earphone apparatus according to any of the embodiments of the first aspect.

In accordance with a third aspect of the present invention, there is provided earphone apparatus according to any of the embodiments of the first aspect (e.g. with the opening configured for allowing sound to pass into the auditory canal of a user's ear and the microphone being a sensing microphone (e.g. for providing a signal to a signal processor)).

The earphone apparatus may comprise circumaural or supra-aural earphones of the type connected together by a headband to form headphones or an in-ear earphone/"in-the-canal" earphone (or stereo pair thereof) configured to be placed at the entrance to or in the auditory canal of a user's ear.

In one embodiment the earphone apparatus is configured to be inserted at least in part into an auditory canal of a user's ear (e.g. an "in-the-canal" device comprising a body configured to substantially seal the auditory canal of the user when the device is inserted into the ear) and the microphone is a sensing microphone comprising a sensing element positioned to sense pressure changes in the auditory canal of the user's ear. In this way, the sensing microphone can provide a feedback signal to a signal processor (or Active Noise Reduction (ANR) processor) to allow for removal of occlusion noise. The signal processor may form part of the earphone apparatus and may be located inside or outside of the housing. In one embodiment the microphone is a MicroElectrical-Mechanical Systems (MEMS) microphone (or "silicon microphone"), e.g. a bottom-port MEMS microphone.

In one embodiment, the earphone apparatus comprises a driver connected to a first opening via a first acoustic waveguide and a sensing microphone (e.g. comprising a sensing element positioned to sense sound present in the auditory canal of the user's ear) connected to a second opening via a second acoustic waveguide, wherein at least one of the first and second acoustic waveguides has a part extending through the substrate substantially normal to the thickness of the substrate. Advantageously, the present applicant has identified that connecting the sensing element of an active occlusion management system to a user's ear canal via a separate acoustic waveguide to the driver advantageously reduces resonance effects generated by the interaction of the driver and the waveguide of the driver. This improvement has been found to be particularly advantageous in applications where the driver is a BA driver or similar high source impedance driver (e.g. of the type comprising a spout or nozzle for transmitting sound to the user's ear) where resonance effects generated by the passageway may be more pronounced than with a conventional low source impedance dynamic driver. By reducing resonance effects generated by the passageway, the sensing microphone can provide a feedback signal which reduces subsequent filtering performed by the signal processor (or Active Noise Reduction (ANR) processor) to allow for improved removal of occlusion noise. The provision of at least one of the acoustic waveguides in the substrate provides a particularly efficient way of implementing this arrangement in a small space (e.g. in an in-ear or in-the-canal earphone).

In an alternative embodiment, the acoustic waveguide extends substantially from the sensing microphone to an opening in the earphone apparatus for receiving acoustic noise external to the user (e.g. to provide feed-forward signal for removing (or at least reducing) ambient noise reaching a user's ear canal).

The earphone apparatus may further comprise a housing for receiving at least part of the substrate. The housing may define an outer profile of the earphone apparatus for insertion in or at the entrance to a user's ear canal.

The earphone apparatus may define a longitudinal axis extending from the opening to a rear part of the housing.

In one embodiment the substrate is a circuit substrate (e.g. printed circuit board or substrate comprising an electrical connection path embedded in a layered structure formed on a semiconductor wafer, such as a semiconductor device).

In one embodiment, the substrate is elongate.

In one embodiment, the substrate extends substantially parallel to the longitudinal axis of the earphone apparatus.

In one embodiment the passageway extends substantially parallel to the longitudinal axis of the earphone apparatus.

In one embodiment, the substrate body defines a neck region extending towards the opening.

In the embodiments defined above, the earphone apparatus may be configured to substantially acoustically seal the auditory canal of the user's ear when inserted into the user's ear (e.g. to improve low frequency response of the system, particularly in a balanced armature driver system).

The earphone apparatus of the present invention may be used in any application in which personal listening is required.

In one embodiment, the earphone apparatus forms part of a hearing-aid.

In another embodiment, the earphone apparatus forms part of a headset including a microphone for a user to speak into (e.g. for use with a mobile telephone).

In accordance with a fourth aspect of the present invention, there is provided a module for microphone apparatus according to any of the embodiments of the first aspect of the present invention (e.g. a module for a portable device (e.g. a portable communications device or portable media player) configured to provide a microphone function in one mode of operation).

In accordance with a fifth aspect of the present invention, there is provided microphone apparatus according to any of the embodiments of the first aspect of the present invention.

In accordance with a sixth aspect of the present invention, there is provided a module for loudspeaker apparatus according to any of the embodiments of the first aspect of the present invention (e.g. a module for a portable device (e.g. a portable communications device or portable media player) configured to provide a loudspeaker function in one mode of operation).

In accordance with a seventh aspect of the present invention, there is provided loudspeaker apparatus according to according to any of the embodiments of the first aspect of the present invention.

In accordance with an eighth aspect of the present invention, there is provided earphone apparatus comprising: a substrate defining at least one electrical connection path; and a transducer mounted on the substrate and connected to the at least one electrical connection path; wherein: the transducer comprises an electro-acoustic driver and the substrate at least in part defines a passageway (e.g. elongate passageway) for conveying sound from the electro-acoustic driver to an opening in the earphone apparatus for allowing sound to pass into the auditory canal of a user's ear; or the transducer comprises a sensing microphone (e.g. for providing a signal to a signal processor) and the substrate at least in part defines a passageway for conveying sound from outside of the earphone apparatus to the sensing microphone.

In accordance with a ninth aspect of the present invention, there is provided a module for an earphone, the module comprising: a substrate (e.g. printed circuit board or a substrate comprising an electrical connection path embedded in a layered structure formed on a semiconductor wafer, such as a semiconductor device) defining at least one electrical connection path; and a transducer mounted on the substrate and connected to the at least one electrical connection path; wherein: the transducer comprises an electro-acoustic driver and the substrate at least in part defines a passageway (e.g. elongate passageway) for conveying sound radiated in a forward direction by the transducer to an outlet spaced from the transducer; or the transducer comprises a sensing microphone and the substrate at least in part defines a passageway for conveying sound to the sensing microphone from an inlet spaced from the sensing microphone.

In one embodiment, the passageway is formed by a channel in an outer surface of the substrate.

In one embodiment, the passageway extends substantially from the transducer to the inlet or extends substantially from the transducer to the outlet.

In one embodiment, at least one further transducer is mounted on the substrate. The at least one further transducer may be an electro-acoustic transducer and sound is conveyed to or from the electro-acoustic transducer via the passageway or via a further passageway.

Embodiments of the present invention will now be described by way of example with reference to the accompanying drawings in which.

Figure 1:
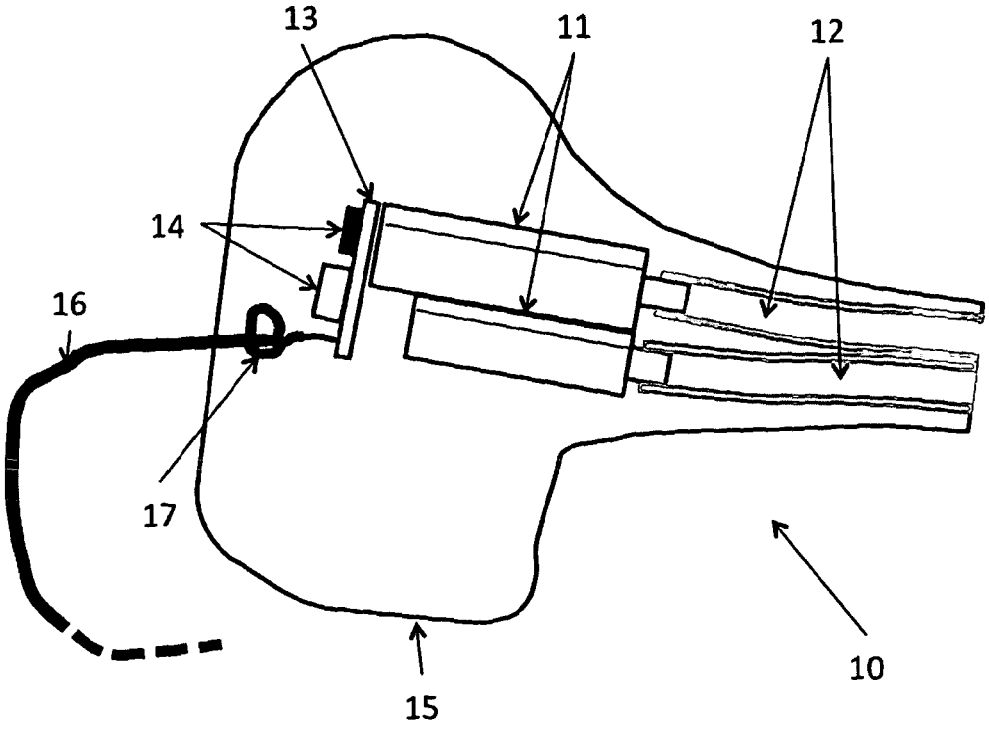
FIGURE 1 (PRIOR ART)
FIG. 1 is a schematic cross-sectional view of a first prior art earphone.
Figure 2:
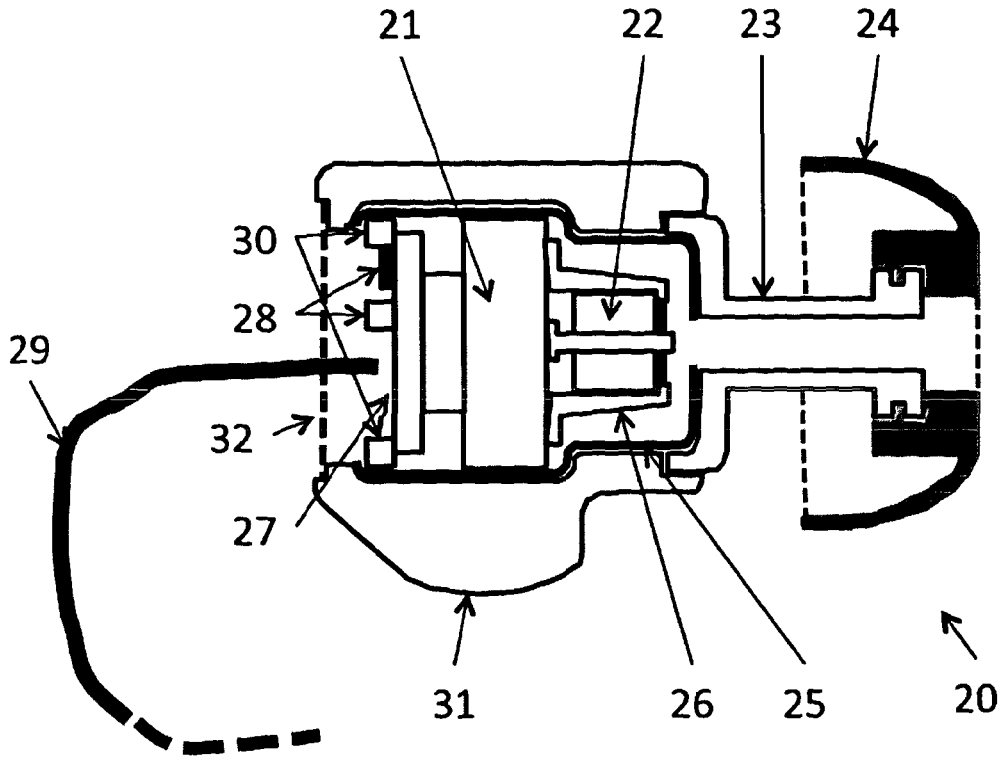
FIGURE 2 (PRIOR ART)
FIG. 2 is a schematic cross-sectional view of a second prior art earphone.
Figure 3:
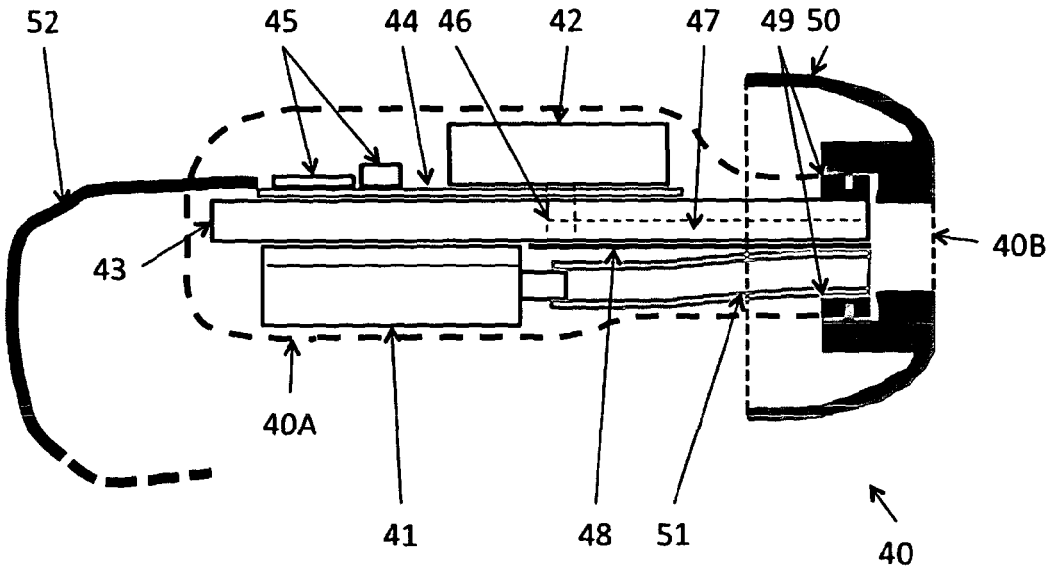
FIG. 3 is a schematic cross-sectional view of earphone apparatus according to a first embodiment of the present invention taken from a first viewpoint.

FIG. 3 shows a noise cancelling earphone apparatus 40 comprising a housing 40A and an opening 40B for transmitting sound into a user's ear canal, housing 40A housing a Balanced Armature (BA) receiver 41 and a MEMS (or "Silicon") microphone 42 sensitive to the pressure inside the wearer's ear canal which is well isolated from exterior sound by a "grommet" or "tip" component 50. Microphone 42 and receiver 41 both are mounted on a common elongate, substantially planar substrate 43 (e.g. a circuit substrate formed using PCB or semiconductor device technology) which acts as "chassis" or "skeleton" for the finished earphone assembly. In this embodiment, substrate 43 includes a neck region 43*a* connected directly to a collar 49 which carries grommet 50.

Electrical connectivity to transducers 41, 42 is achieved through electrical tracks 44 on the substrate component 43 leading to solder pads (or some alternative electrical connection means) convenient for the attachment of external wiring 52. Additional electronic components (active or passive) 45 are mounted on the common substrate 43 on the tracks 44. Mechanical support for transducers 41, 42 is provided by fixing them to the substrate. In the case of the microphone 42, the mechanical connection is provided by flow soldering to pads intentionally placed on substrate 43. It can be seen that substrate 43 advantageously may be constructed using "Printed Circuit Board" technologies. In the case of the receiver 41, mechanical mounting is achieved using adhesive.

Microphone 42 includes an acoustic port provided on the same face as the electrical connections, which also serve the mechanical function of physically securing the microphone. Sound is conducted through a waveguide formed in the substrate from the ear to the microphone. Waveguide 47 may (for example) be formed by milling a channel in the substrate (on the opposite side to that bearing the MEMS microphone 42) which connects with a hole 46 opening to the microphone's acoustic port. The channel is closed to form waveguide 47 by a further component 48 which may conveniently be adhesive tape or a second layer of substrate, bonded to (or otherwise deposited over) the first, once the milling process has formed the channel. In the case of manufacturing the substrate using PCB technology, the channel milling can be performed using the familiar routing machines which are used to profile the boards.

BA receiver 41 provides acoustic output from a "spout". For convenience, sound is conducted from this spout to the ear via a tube 51 which terminates at collar 49.

Accordingly, the substrate 43 provides mechanical and acoustical function for the microphone 42 even though it only serves mechanical and electrical functions with reference to the receiver, 41.

Figure 4:
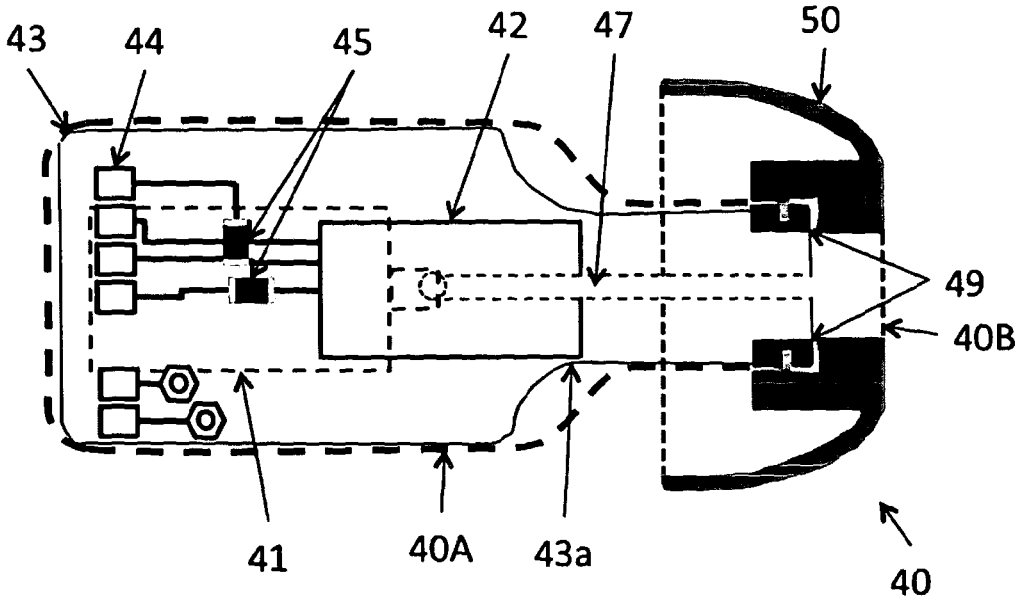
FIG. 4 is a schematic cross-sectional view of the earphone apparatus of FIG. 3 taken from a second (plan) viewpoint.

FIG. 4 shows earphone apparatus 40 from a viewpoint above the substantially planar substrate 43. MEMS microphone 42 is visible above the substrate, but the receiver is on the underside. Substrate 43 is shaped so as to provide convenient fit into the wearer's ear. Although the substrate of FIG. 4 is shown as having outline symmetry about a horizontal line coincident with the major axis of the waveguide 47 such symmetry is not mandatory. In the absence of such symmetry, the substrate may be handed, so as to provide mirror symmetry (left/right) for a stereo or binaural system. Alternatively, the substrate (and the components on it) may be deployed "upside down" in one ear with little impact on performance, thereby reducing system cost.

Housing 40A acts as an overall shell component to contribute to comfort within the wearer's ear, but is otherwise principally cosmetic. Housing 40A may, for example, be applied using a moulding process similar to the familiar "potting" encapsulation for electronic sub-systems.

Figure 5:
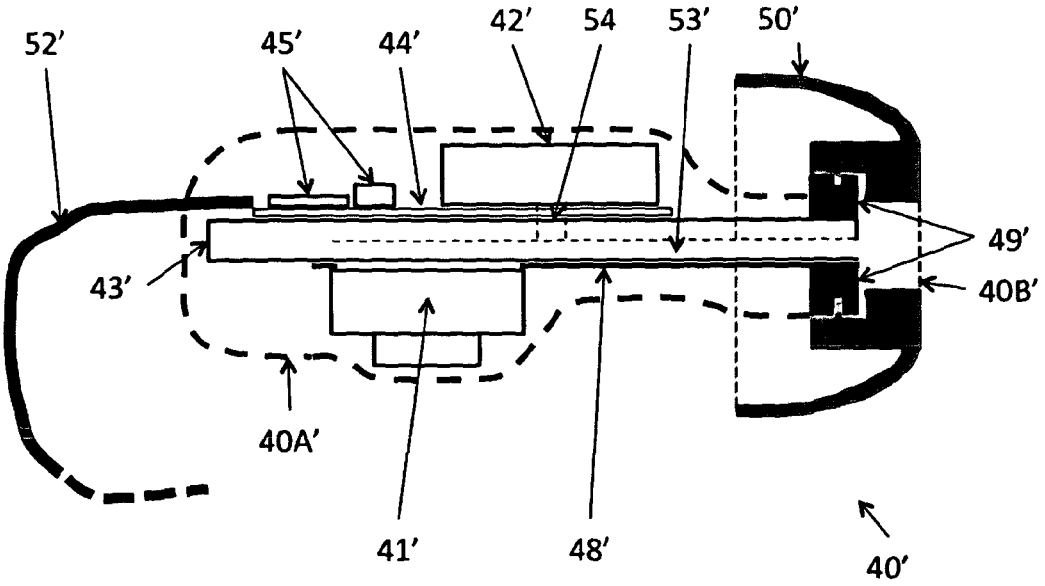
FIG. 5 is a schematic cross-sectional view of earphone apparatus according to a second embodiment of the present invention.

FIG. 5 shows earphone apparatus 40' comprising a housing 40A' and an opening 40B' for transmitting sound into a user's ear canal, housing 40A' housing a dynamic receiver 41' and microphone 42' (other features in common with the earphone apparatus 40 of FIG. 3 are labelled accordingly). Front-radiated sound from dynamic receiver 41' is conducted through a channel 53 formed in a common elongate, substantially planar substrate component (or chassis) 43' (e.g. a circuit substrate formed using PCB or semiconductor device technology). Microphone 42' is coupled to a microphone channel 54 in the substrate, as already illustrated in FIG. 3. Microphone channel 54 may communicate directly with the channel conveying sound from receiver 53' to opening 40B'. Alternatively, microphone channel 54 may be isolated from channel 53 of receiver 41' (i.e. extend from microphone 42' to opening 40B'), with acoustic coupling being achieved only after both channels 53, 54 open to the ear, through components 49', 50'. Similarly, other transducer combinations, such as an ECM microphone with a "spout" acoustic port may be used with tube coupling to the ear.

Figure 6:
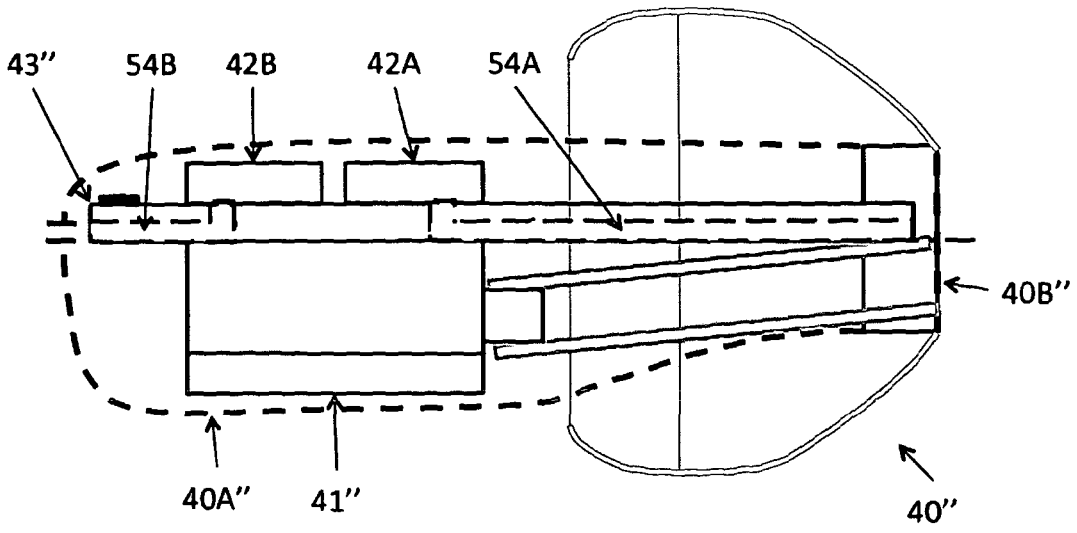
FIG. 6 is a schematic cross-sectional view of earphone apparatus according to a third embodiment of the present invention.

FIG. 6 shows earphone apparatus 40" comprising a housing 40A" and an opening 40B" for transmitting sound into a user's ear canal, housing 40A" housing a receiver 41" and a pair of microphones 42A and 42B. Sound from dynamic receiver 41' is conducted through waveguide 47' to opening 40B". Microphones 42A and 42B are coupled to microphone channels 54A and 54B respectively formed in a common elongate, substantially planar substrate component (or chassis) 43" (e.g. a circuit substrate formed using PCB or semiconductor device technology). Like microphones 42 and 42', microphone 42A is configured to measure noise from the user's ear canal for the purposes of reducing the occlusion effect occurring in in-the-canal earphones or removing (or at least reducing) ambient noise reaching the user's ear canal. Microphone 42B is configured to measure ambient noise (i.e. external to the user ad earphone) for the purpose of generating a feed-forward signal for removing (or at least reducing) ambient noise reaching a user's ear canal.

Importantly, the present invention additionally envisages receivers with acoustic ports on the same surface as the electrical connection, such that the same electrical connection, acoustic coupling and mechanical mounting taught for the MEMS microphone (FIG. 3) also may be exploited for the receiver.

Figure 7:
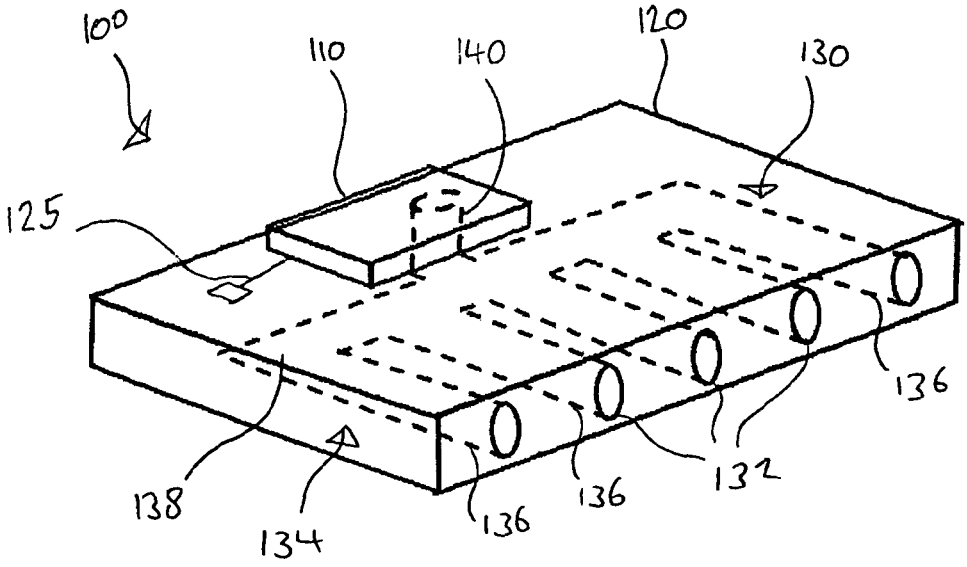
FIG. 7 is a schematic perspective view of a microphone module according to another embodiment of the present invention.

FIG. 7 shows a microphone module 100 for use in apparatus having a microphone function (e.g. a noise-cancelling earphone, a portable communications device, portable media device or the like), the microphone module 100 comprising a MEMS microphone 110 mounted or integrally formed on a substantially planar substrate component 120 (e.g. a circuit substrate formed using PCB or semiconductor device technology) defining an integral electrical connection path 125 for connecting microphone 110 to a signal processor (not shown) and an acoustic waveguide system 130 including a plurality of laterally spaced inlets 132 for allowing sound external to the apparatus to pass through substrate component 120 to microphone 110. Acoustic waveguide system 130 comprises: a manifold structure 134 comprising a plurality of elongate linear passageways 136 extending substantially normal to the thickness of the substrate and each ending in a respective inlet 132, and an elongate linear passageway 138 extending substantially normal to the thickness of the substrate connecting each of the linear passageways 134; and a connecting passageway 140 extending substantially parallel to the thickness of the substrate to connect the manifold structure 134 to microphone 110.

In use each of the inlets 132 is exposed to pressure at a slightly different location. Manifold structure 134 imposes a filtering action on the individual pressures before they are summed and presented to microphone 110. The overall response of the microphone module 100 (as formed by microphone 110 and substrate component 120) has a directional response which may be engineered by appropriate positioning of inlets 132 and design of manifold structure 134 to implement a directional microphone (e.g. directional noise-cancelling microphone) for use in devices having a telephone or video-recording function.

Figure 8:
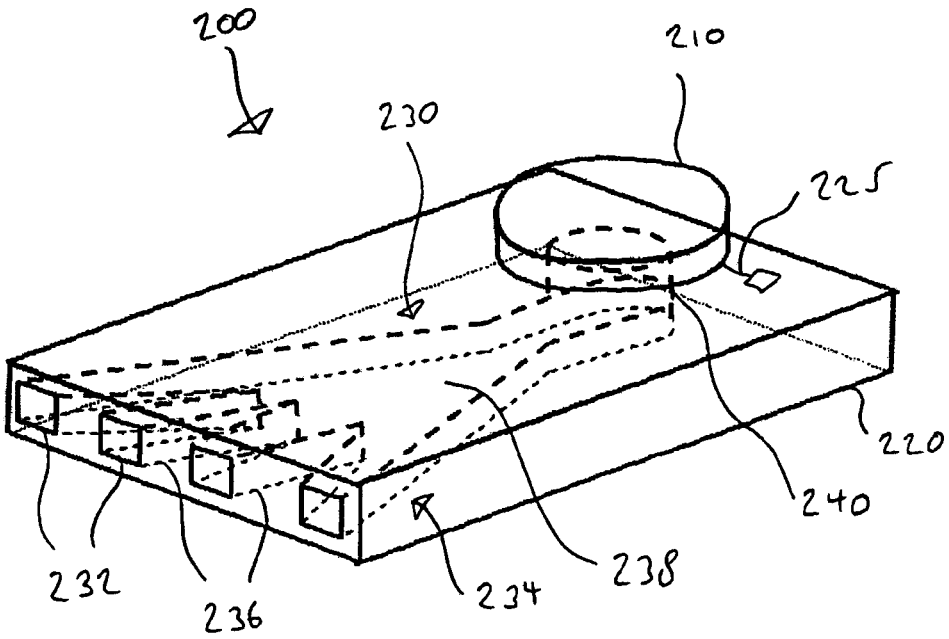
FIG. 8 is a schematic perspective view of a miniature loudspeaker module according to another embodiment of the present invention.

FIG. 8 shows a miniature loudspeaker module 200 for use in apparatus having a loudspeaker function (e.g. a portable communications device, portable media player or the like), the loudspeaker module 200 comprising an electro-acoustic driver 210 mounted or integrally formed on a substantially planar substrate component 220 (e.g. a circuit substrate formed using PCB or semiconductor device technology) defining an integral electrical connection path 225 for connecting driver 210 to an amplifier (not shown) and an acoustic waveguide system 230 including a plurality of laterally spaced outlets 232 for allowing sound generated by driver 210 to pass through substrate component 220 to outside of the apparatus. Acoustic waveguide system 230 comprises: a manifold structure 234 comprising a plurality of elongate linear passageways 236 extending substantially normal to the thickness of the substrate and each ending in a respective outlet 232, and a tapered chamber 238 connecting each of the linear passageways 234; and a connecting passageway 240 configured to connect the manifold structure 234 to driver 210.

In use each of the outlets 232 exhibit mutual impedance effects when correlated sound radiated sound from driver 210 is radiated from them. Manifold structure 234 may be designed to couple the radiation load at outlets 232 of the substrate to the source impedance of driver 210 (i.e. to form a discretized horn), thereby increasing efficiency. Additionally, the manifold may be designed so as to modify the directivity of sound radiated from the module 200. This makes possible the implementation of efficient and potentially direction sound radiation in portable communications devices such as smartphones and portable computers.

Figure 9:
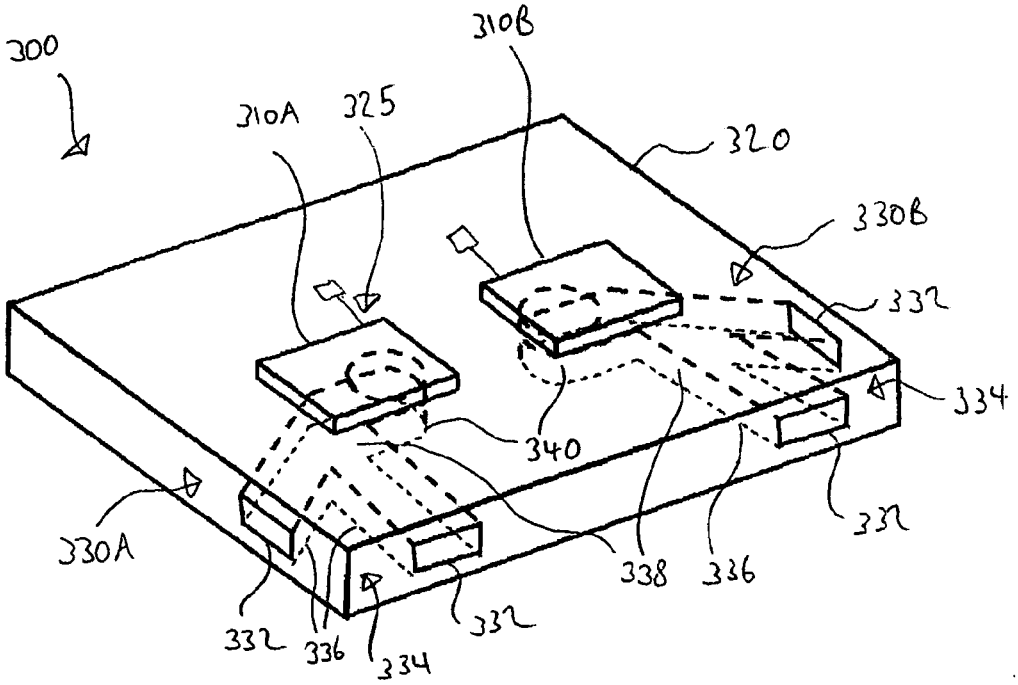
FIG. 9 is a schematic perspective view of a miniature loudspeaker module according to a further embodiment of the present invention.

FIG. 9 shows a miniature loudspeaker module 300 for use in apparatus having a loudspeaker function (e.g. a portable communications device, portable media player or the like), the loudspeaker module 300 comprising a pair of electro-acoustic drivers 310A, 310B mounted or integrally formed adjacent one another in a central location on a common, substantially planar substrate component 320 (e.g. a circuit substrate formed using PCB or semiconductor device technology) defining an integral electrical connection path 325 for connecting drivers 310A, 310B to an amplifier (not shown). Substrate component 320 defines a pair of acoustic waveguide systems 330A, 330B including a pair of laterally widely spaced outlets 332 located on adjacent sides of the substrate component 320 and configured to allow sound generated by drivers 310A, 310B respectively to pass through substrate component 320 to outside of the apparatus. Each acoustic waveguide system 330A, 330B comprises: a manifold structure 334 comprising a plurality of elongate linear passageways 336 extending substantially normal to the thickness of the substrate and each ending in a respective outlet 332, and a chamber 338 connecting each pair of the linear passageways 334; and a connecting passageway 340 extending substantially parallel to the thickness of the substrate to connect the manifold structure 334 to its respective driver 310A, 310B.

Loudspeaker module 300 may be configured to provide a directional sound source (e.g. when the outputs of drivers 310A, 310B are appropriately correlated) or a stereo sound source from a pair of centrally located drivers.

Figure 10:
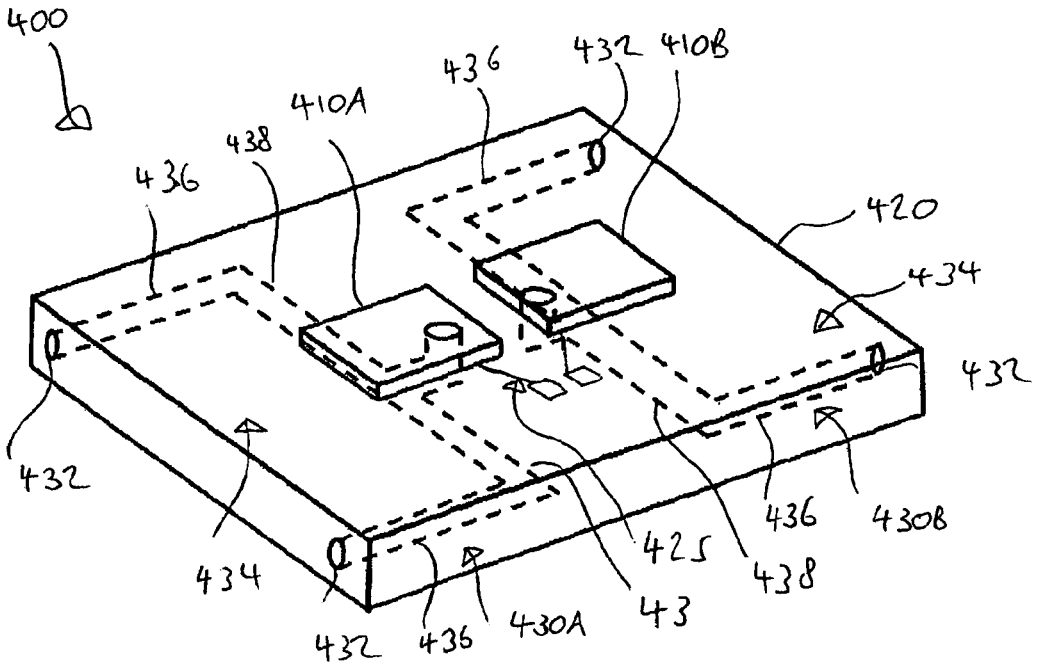
FIG. 10 is a schematic perspective view of a microphone module according to another embodiment of the present invention.

FIG. 10 shows a directional microphone module 400 for use in apparatus having a microphone function (e.g. a noise-cancelling earphone apparatus, a portable communications device, portable media player or the like), the microphone module 400 comprising a pair of MEMS microphones 410A, 410B mounted or integrally formed adjacent one another in a central location on a common, substantially planar substrate component 420 (e.g. a circuit substrate formed using PCB or semiconductor device technology) defining an integral electrical connection path 425 for connecting microphones 410A, 410B to a signal processor (not shown). Substrate component 420 defines a pair of acoustic waveguide systems 430A, 430B including a pair of laterally widely spaced inlets 432 for allowing sound external to the apparatus to pass through substrate component 420 to each respective microphone 410A, 140B (i.e. to provide pressures sampled at opposite extremes of substrate component 420). Each acoustic waveguide system 430A, 430B comprises: a manifold structure 434 comprising a plurality of elongate linear passageways 436 extending substantially normal to the thickness of the substrate and each ending in a respective inlet 432, and an elongate linear passageway 438 extending substantially normal to the thickness of the substrate connecting each pair of the linear passageways 434; and a connecting passageway 440 extending substantially parallel to the thickness of the substrate to connect each manifold structure 434 to its respective microphone 410A, 410B.

In use pressures at inlets 432 are filtered by the action of passageways 436 which combine the pressures before transduction at microphones 410A, 410B. In this way, a higher order directional, noise suppressing microphone or a stereo microphone may be provided for use in a telephone (or other such communications device incorporating a microphone function), video camera or the like.

Figure 11:
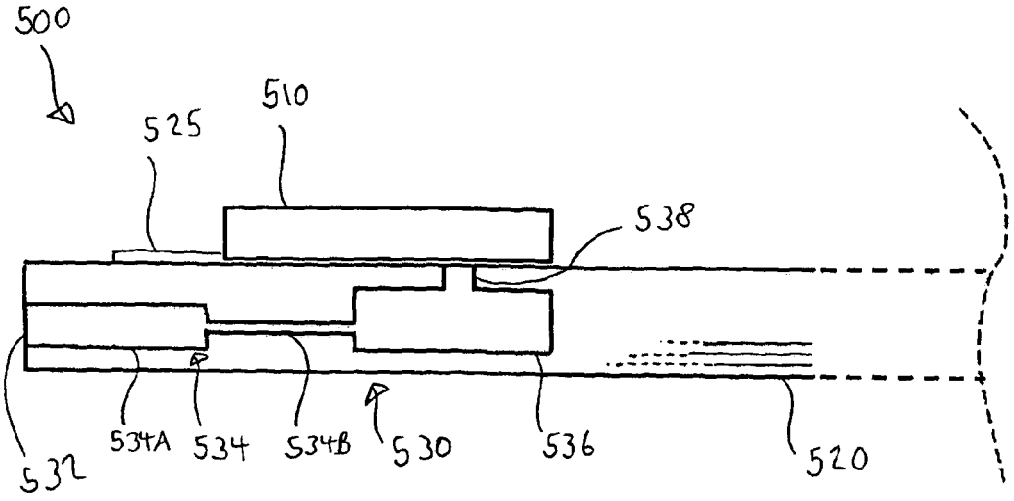
FIG. 11 is schematic cross-sectional view of a microphone module according to a yet further embodiment of the present invention.

FIG. 11 shows a microphone module 500 for use in apparatus having a microphone function (e.g. a noise-cancelling earphone apparatus, a portable communications device, portable media device or the like), the microphone module 500 comprising a MEMS microphone 510 mounted or integrally formed on a substantially planar substrate component 520 (e.g. a circuit substrate formed using PCB or semiconductor device technology) defining an integral electrical connection path 525 for connecting microphone 510 to a signal processor (not shown) and an acoustic waveguide system 530 including an inlet 532 for allowing sound external to the apparatus to pass through substrate component 520 to microphone 510. Acoustic waveguide system 530 comprises an elongate linear passageway 534 extending substantially normal to the thickness of the substrate and ending in inlet 532, a chamber 536 connected to passageway 534, and a connecting passageway 538 extending substantially parallel to the thickness of the substrate to connect chamber 536 to microphone 510. Passageway 534 comprises a first and second parts 534A, 534B connected in series, the second part 534B having a restricted cross-section relative to the first part 534A and connecting the first part 534A to chamber 536. The geometry of second part 534B is configured to encourage lumped-parameter behaviour as a resistance and/or inductance and the geometry of chamber 536 (having a larger cross-sectional area than first part 534A) is configured to provide compliance. In this way, substrate component 520 may facilitate an acoustic low-pass filter network in front of microphone 510. This makes possible, for example, the control of unwanted high frequency resonant effects in the response of silicon microphones.

Figure 12:
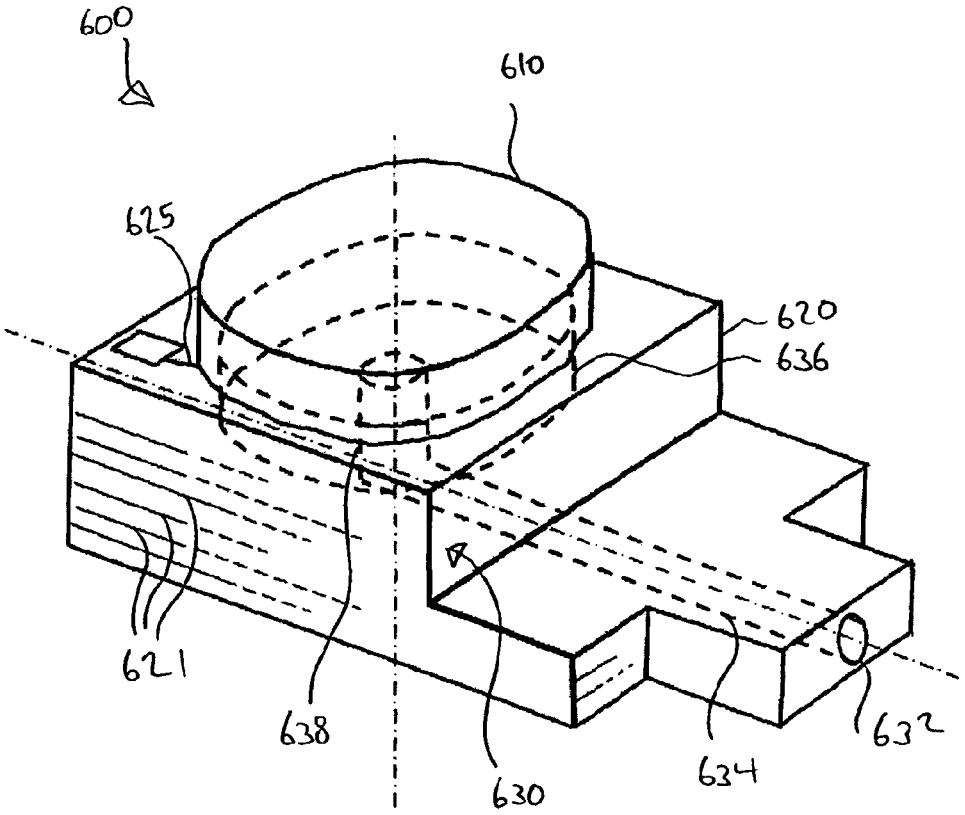
FIG. 12 is a schematic perspective view of an audio module comprising a non-planar body according to a further embodiment of the present invention.

FIG. 12 shows an audio module 600 for use in apparatus having a microphone or sound-generating function (e.g. a noise-cancelling earphone apparatus, a portable communications device, portable media device or the like), the audio module 600 comprising an electromagnetic transducer 610 mounted or integrally formed on a non-planar circuit substrate 620 (e.g. a non-planar circuit substrate formed using PCB or semiconductor device technology) defining an integral electrical connection path 625 and an acoustic waveguide system 630 including an inlet/outlet 632 for allowing sound to pass between transducer 610 and a region outside of the apparatus. Circuit substrate 620 extends substantially in three spatial dimensions, having been formed from a process in which a plurality of substantially planar substrate layers 621 are bonded together or sequentially deposited in order to achieve the desired extension in the third dimension. Waveguide system 630 comprises an elongate linear passageway 634 extending substantially normal to the thickness of layers 621 and ending in inlet/outlet 632, a chamber 636 leading to transducer 610 and a connecting passageway 638 extending substantially parallel to the thickness of layers 621 to connect chamber 636 to passageway 634. For the purposes of the foregoing specific description, the terms substrate and circuit substrate should be understood not to be limited to embodiments as a printed circuit board nor to generation using PCB processing methods. Any substrate component used in production of an audio device which provides electrical, acoustical and mechanical support to at least one of the transducers is subject of the present invention. This explicitly includes any substrate component used in integrated circuit, "System-in-Package" or similar manufacturing methodologies, extant or not yet invented.

Furthermore, in all of the illustrated examples above it should be understood that a substrate with its attendant transducers may be further mounted in an enclosure (e.g. casing) that further directs sound to/from the opening(s) in the substrate to locations (e.g. potentially distant locations) within or on an outer surface of the enclosure. In this way the manufacturing and integration advantages of the substrate-mounted transducer and allows the enclosure to act as a diffracting/reflecting/baffling object, generating greater independence between acoustic inputs/outputs. For example, when a module of the present invention is placed within a shell/cup to form one side of a headphone, the cup defines acoustic front/back loads for the substrate-mounted electroacoustics and makes physical coupling to the wearer's head. When a module of the present invention is placed within an enclosure of a portable communications or media device, the enclosure may include internal waveguides to couple with and extend the part of the acoustic waveguide extending through the substrate, thereby allowing increased directional control of radiation or received sound and increased flexibility regarding the location of the module within the enclosure.

The invention claimed is:

1. Earphone apparatus comprising:

a substantially planar substrate defining at least one electrical connection path; and a transducer provided on or in the substrate and connected to the at least one electrical connection path;

wherein:

the transducer comprises an electro-acoustic driver and the substrate at least in part defines an acoustic waveguide having a part extending through the substrate for conveying sound from the electro-acoustic driver to an opening in the earphone apparatus for allowing sound to pass into the auditory canal of a user's ear; or the transducer comprises a sensing microphone and the substrate at least in part defines an acoustic waveguide having a part extending through the substrate for conveying sound from outside of the earphone apparatus to the sensing microphone; and the part of the acoustic waveguide extends through the substrate substantially normal to the thickness of the substrate.

2. Earphone apparatus according to claim 1, wherein the substrate is a printed circuit board or a substrate comprising an electrical connection path embedded in a layered structure formed on a semiconductor wafer.

3. Earphone apparatus according to claim 2, wherein the substrate is a semiconductor device and the transducer is integral to the substrate.

4. Earphone apparatus according to claim 1, wherein the acoustic waveguide is formed by a channel in an outer surface of the substrate.

5. Earphone apparatus according to claim 1, wherein the part of the acoustic waveguide is formed by a passageway having a section formed fully within the substrate.

6. Earphone apparatus according to claim 1, wherein the acoustic waveguide extends substantially from the transducer to the opening in the earphone apparatus.

7. Earphone apparatus according to claim 1, wherein the part of the acoustic waveguide is connected to the transducer by a connection chamber.

8. Earphone apparatus according to claim 1, wherein the part of the acoustic waveguide comprises a manifold structure.

9. Earphone apparatus according to claim 1, wherein the transducer comprises a sensing microphone and the acoustic waveguide extends substantially from the transducer to a further opening in the earphone apparatus for receiving acoustic noise external to the user.

10. Earphone apparatus according to claim 1, wherein the earphone apparatus is configured to be inserted at least in part into an auditory canal of a user's ear.

11. Earphone apparatus according to claim 10, wherein the sensing microphone comprises a sensing element positioned to sense sound present in the auditory canal of the user's ear.

12. Earphone apparatus according to claim 1, wherein at least one further transducer is provided in or on the substrate.

13. Earphone apparatus according to claim 12, wherein the at least one further transducer is an electro-acoustic transducer and sound is conveyed to or from the electro-acoustic transducer via the acoustic waveguide or via a further acoustic waveguide.

14. Earphone apparatus according to claim 1, wherein the earphone apparatus forms part of a hearing-aid.

15. Earphone apparatus according to claim 1, wherein the earphone apparatus forms part of a headset including a microphone for a user to speak into.

16. Earphone apparatus according to claim 1, further comprising a housing for receiving at least a part of the substrate, the housing defining an outer profile for insertion in or at an entrance to an ear canal.

17. Earphone apparatus according to claim 1, further comprising an earphone assembly, the earphone assembly comprising the substrate and the transducer, wherein the substrate acts as a chassis for the earphone assembly.

18. Earphone apparatus according to claim 1, wherein the substrate includes a neck region extending toward the opening.

* * * * *